United States Patent [19]

Pilao

[11] 3,984,057

[45] Oct. 5, 1976

[54] REFINER FOR WOOD PULP OR THE LIKE

[76] Inventor: Milton Pilao, Rua Campo Largo, 369 CEP-03186, Sao Paulo, Brazil

[22] Filed: Jan. 23, 1975

[21] Appl. No.: 543,619

[30] Foreign Application Priority Data

Jan. 15, 1975 Brazil ..... 353

[52] U.S. Cl. ..... 241/248; 241/259.1; 241/261.1; 241/261.3

[51] Int. Cl.[2] ..... B02C 7/14

[58] Field of Search ..... 241/244, 245, 248, 259.1, 241/261.1, 261.2, 261.3

[56] References Cited

UNITED STATES PATENTS

| | | | |
|---|---|---|---|
| 2,561,043 | 7/1951 | Ayers | 241/245 X |
| 2,968,444 | 1/1961 | Jones | 241/245 X |
| 3,438,586 | 4/1969 | Cancilla | 241/259.1 X |
| 3,614,826 | 10/1971 | Pilao | 241/244 X |
| 3,841,573 | 10/1974 | Kahmann | 241/245 |
| 3,845,910 | 11/1974 | Cledaniel | 241/245 |
| 3,854,667 | 12/1974 | Baehr et al. | 241/46.11 |

FOREIGN PATENTS OR APPLICATIONS

| | | | |
|---|---|---|---|
| 1,158,726 | 6/1958 | France | 241/261.1 |
| 1,217,180 | 5/1966 | Germany | 241/244 |

*Primary Examiner*—Granville Y. Custer, Jr.
*Assistant Examiner*—Howard N. Goldberg
*Attorney, Agent, or Firm*—Michael J. Striker

[57] ABSTRACT

A disc refiner for pulp has a housing defining a chamber with an inlet and an outlet, three coaxial discs mounted in the chamber, and a shaft which rotates the central disc and extends with clearance through a large opening in one of the outer discs. The other outer disc is adjustable axially toward and away from the central disc and the central disc is movable axially of the shaft between the two outer discs. The stock enters via inlet and passes through the opening of the one outer disc. A portion of stock thereupon passes radially outwardly between the one outer disc and the central disc to be comminuted by ribs on the adjacent surfaces of the one outer disc and the central disc. The remaining portion of stock flows through several relatively large openings of the central disc and thereupon radially outwardly toward the outlet by passing between ribs provided on the neighboring surfaces of the central disc and the other outer disc. Each of the discs is a one-piece body.

2 Claims, 7 Drawing Figures

FIG. 5
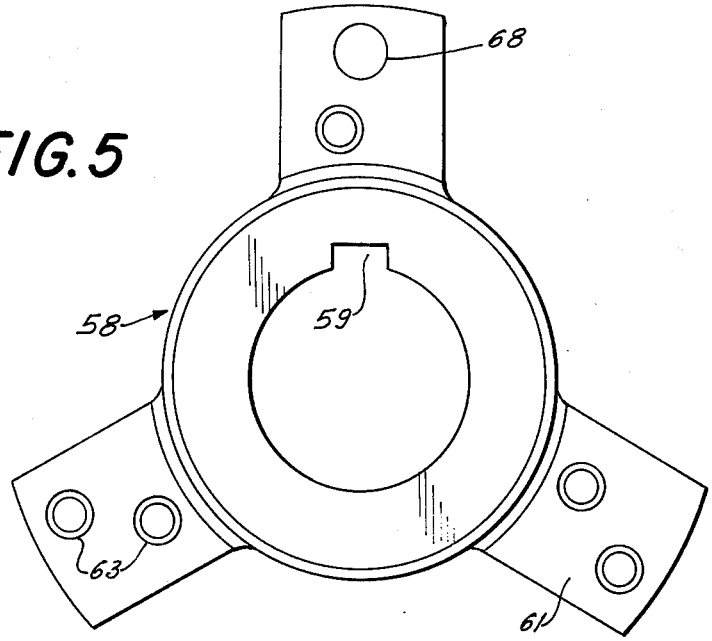
FIG. 6
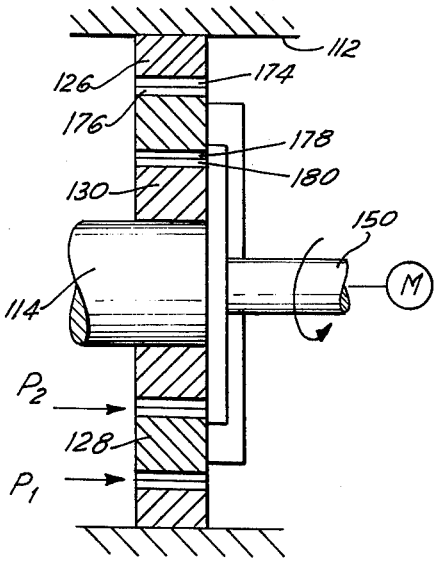
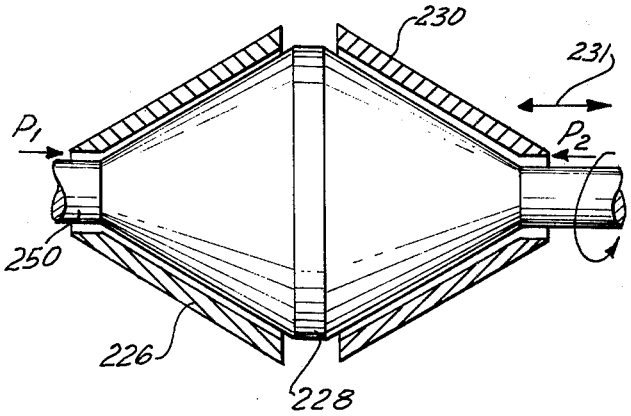
FIG. 7

REFINER FOR WOOD PULP OR THE LIKE

BACKGROUND OF THE INVENTION

The present invention relates to refiners for wood pulp or the like, and more particularly to improvements in refiners wherein stationary refining members flank rotary refining means in the chamber of the housing whose inlet admits stock for treatment by comminuting projections (e.g., ribs) on the neighboring surfaces of stationary refining members and rotary refining means.

It is already known to utilize in a disc refiner two coaxial or eccentric discs each of which is driven by a discrete prime mover and which have neighboring surfaces provided with ribs or otherwise configurated projections which comminute the material to be treated while the material advances from the inlet toward the outlet of the stock chamber. Such refiners are rather expensive because they must employ several prime movers. Furthermore, the adjustment of one or both discs axially of and relative to each other is complex and time-consuming because the discs must be adjusted with or relative to their prime movers.

It is further known to use a pair of discs one of which is stationary and the other of which rotates relative to the stationary disc. Such refiners are unsatisfactory because their output is relatively low.

It is also known to dispose two rotary discs between two stationary discs so that each rotary disc cooperates with a different stationary disc. The rotary discs are mounted at the opposite sides of a disc-shaped carrier which is driven by a shaft. The stock is fed through one of the stationary discs to enter the space between the one stationary disc and the respective rotary disc, and some of the stock is allowed to pass through relatively small openings in the rotary discs and carrier to enter the space between the other rotary disc and the other stationary disc. Such refiners are not entirely satisfactory because the quantity of stock which passes through the rotary discs and the carrier is relatively small so that the major part of the stock is treated between the one stationary disc and the corresponding rotary disc. This causes excessive wear upon the ribs of the other rotary disc and the other stationary disc as a result of metal-to-metal contact between the respective ribs. Moreover, the assembly of discs inclusive of the carrier is rather long and bulky, and the energy requirements of the prime mover for the rotary discs are high because the prime mover must rotate the rotary discs, the relatively heavy carrier between the rotary discs, and the means for coupling the rotary discs to the carrier.

SUMMARY OF THE INVENTION

An object of the invention is to provide a novel and improved refiner for pulp or other types of fibrous stock used in paper making and related industries.

Another object of the invention is to provide a refiner wherein the stock is treated during travel along several paths and wherein the treatment of stock in each of the discrete paths is identical.

A further object of the invention is to provide a compact refiner wherein the number of disc-shaped or otherwise configurated refining members exceeds two and wherein the rotary refining member need not be driven through the intermediary of a carrier or the like.

An additional object of the invention is to provide a refiner wherein a single rotary refining member can cooperate with several stationary refining members and wherein the wear upon all refining members is the same.

Still another object of the invention is to provide the improved refiner with novel means for insuring uniform distribution of stock to be treated among several discrete paths along which the stock advances from the inlet toward the outlet of the stock chamber.

A further object of the invention is to provide a novel and improved rotary refining member for use in the above outlined refiner.

Another object of the invention is to provide a novel and improved mounting for the rotary refining member.

The invention is embodied in a refiner for pulp or like materials which comprises a housing having a stock chamber, a material-admitting inlet and an outlet, spaced-apart first and second refining members mounted in the chamber, a rotary third refining member disposed in the chamber between the first and second refining members and defining therewith first and second paths along which the material can advance from the inlet toward the outlet, first and second comminuting projections respectively provided on the first and second refining members adjacent to the first and second paths, third and fourth comminuting projections provided on the third refining member and being respectively adjacent to the first and second paths opposite the first and second comminuting projections to cooperate therewith for comminuting or grinding the stock which passes toward the outlet, and means for rotating the third refining member. The refining members may constitute discs, cones or annuli, and their projections are preferably ribs which are suitably distributed on the respective surfaces.

In accordance with a presently preferred embodiment, the comminuting members are coaxial discs and the first member has a centrally located opening which communicates with the inlet and admits material into the first path as well as into one or more relatively large openings in the third member whereby a substantial amount of stock can flow from the opening of the first member into the second path. The second member is preferably adjustable axially toward and away from the third member and the latter is preferably free to move axially between the first and second members, either with or relative to the rotating means. For example, the rotating means may comprise a shaft which extends through the opening of the first member and has a hub which transmits torque to the third member but allows the latter to move axially therealong.

The novel features which are considered as characteristic of the invention are set forth in particular in the appended claims. The improved refiner itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 5 is an elevational view of a hub which forms part of the means for rotating the third refining member in the refiner of FIG. 1;

FIG. 6 is a schematic fragmentary central sectional view of a second refiner with annular refining members; and FIG. 7 is a schematic fragmentary partly elevational and partly sectional view of a third refiner with conical refining members.

DESCRIPTION OF THE PREFERRED EMBODIMENTS

Figure 1:
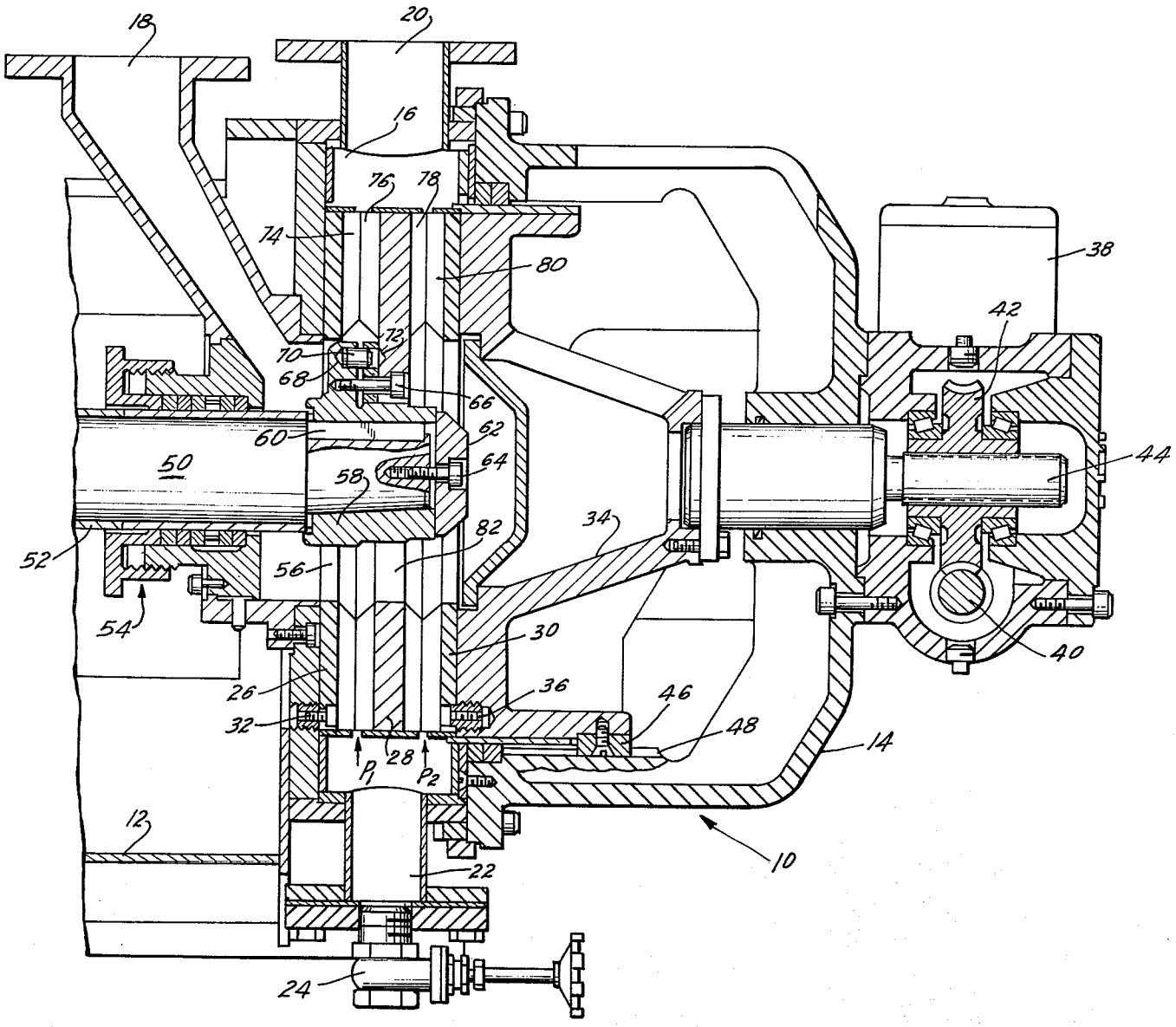
FIG. 1 is a fragmentary longitudinal vertical sectional view of a refiner which embodies one form of the invention.

Referring first to FIG. 1, there is shown a disc refiner having a housing 10 including several bolted-together sections two of which are shown at 12 and 14. The housing defines a stock chamber 16 and has an inlet 18 for admission of pulp, e.g., from the outlet of a pump, a first outlet 20 for evacuation of refined pulp, at least in part under the action of centrifugal force, and a second outlet 22 which is normally closed by a suitable valve 24. The outlet 20 extends upwardly and the outlet 22 extends downwardly; the valve 24 is opened when the attendants wish to drain the liquid carrier for wood chips or the like from the chamber 16.

The chamber 16 accommodates three refining members 26, 28, 30 here shown as coaxial discs having identical outer diameters (e.g., 20 inches). The disc 26 is stationary and is fixedly secured to the housing section 12 by screws 32 or analogous fasteners. The disc 30 does not rotate; this disc is spaced apart from the disc 26 and is secured to an axially movable support 34 by means of screws 36 or the like. The support 34 is mounted in the housing section 14 and is movable axially of the discs 26, 28 by a reversible electric motor 38 which can drive a worm 40. The latter meshes with a worm wheel 42 having internal threads in mesh with external threads at the right-hand end of a spindle 44 which is rigid with the support 34. The support 34 has one or more radial projections or followers 46 slidable in elongated grooves 48 of the housing section 14. The grooves 48 are parallel to the common axis of the discs 26, 28 and 30.

The disc 28 is rotatable relative to and is movable axially between the discs 26 and 30. The means for rotating the disc 28 comprises a drive shaft 50 which rotates in a sleeve 52 mounted in the housing section 12. The sleeve 52 is surrounded by a stuffing box 54 which prevents the escape of pulp from the chamber 16 into the left-hand portion of the housing section 12. That end portion of the shaft 50 which extends from the housing section 12 preferably carries a pulley or sprocket wheel driven by an electric motor or another suitable prime mover through the medium of an endless belt or chain. Other types of transmissions between the prime mover and the shaft 50 can be used with equal advantage.

The disc 26 has a relatively large central opening 56 which communicates with the inlet 18 and surrounds the shaft 50 with a substantial amount of clearance. That end portion of the shaft 50 which extends beyond the opening 56 and into the central part of the chamber 16 carries a hub 58 which is secured thereto by a key 60, a cap 62 and a screw 64 so that the hub 58 shares all angular movements of the shaft 50. The hub 58 transmits torque to the centrally located disc 28 by way of several screws 66 but the disc 28 has limited freedom of axial movement relative to the hubs 58 and screws 66. The hub is provided with an eccentric blind bore 68 for a guide pin 70 a portion of which extends into an aligned blind bore 72 of the disc 28. It can be said that the disc 28 "floats" between the discs 26, 30 and automatically finds a central position between the stationary discs 26, 30, not only in response to wear on the surfaces of comminuting projections on the discs but also upon axial adjustment of the disc 30.

The discs 26, 28 and 28, 30 respectively define first and second paths $P_1$ and $P_2$ along which the pulp can advance from the inlet 18 toward the first outlet 20 (the second outlet 22 is assumed to be sealed when the refiner is in use). The path $P_1$ is flanked by rib-shaped comminuting projections 74, 76 of the discs 26, 28, and the path $P_2$ is flanked by rib-shaped comminuting projections 78, 80 of the discs 28, 30. The opening 56 of the disc 26 admits pulp from the inlet 18 into the central portion of the first path $P_1$, and such pulp flows radially outwardly between the projections 74, 76 toward the outlet 20. The central portion of the disc 28 has three kidney-shaped openings 82 whose combined cross-sectional area is less than the effective area of the opening 56. The openings 82 connect the path $P_1$ with the path $P_2$ so that some of the pulp which is admitted via opening 56 flows through the openings 82 and into the path $P_2$ to be comminuted by the projections 78, 80 on its way toward the outlet 20.

The height of the projections 74, 80 may slightly exceed the axial length or thickness of the respective discs 26, 30. The height of the projections 76, 78 on the disc 28 may be slightly or substantially less than the thickness or axial length of the disc 28. The thickness of the disc 28 preferably exceeds the thickness of the disc 26 or 30.

An important feature of the improved refiner is that the disc 28 is a one-piece body, the same as the disc 26 or 30. The projections 74, 76, 78, 80 may be made integral with the respective discs or they may form segments which are separably secured to the respective discs, for example, in a manner as disclosed in the commonly owned U.S. Pat. No. 3,614,826.

Figure 2:
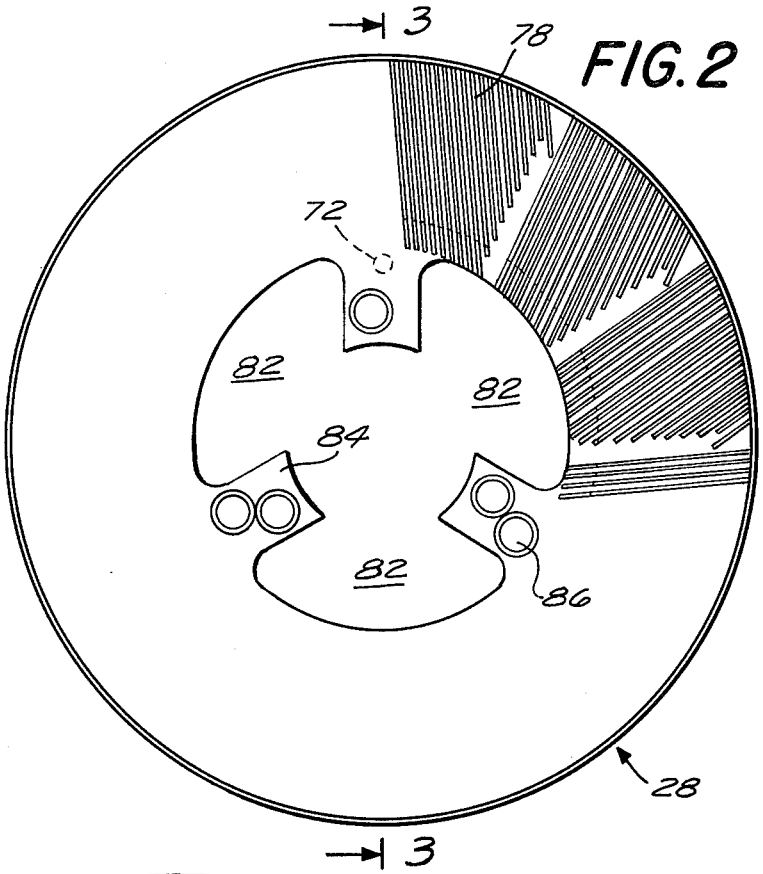
FIG. 2 is a side elevational view of the rotary refining member in the refiner of FIG. 1.
Figure 3:
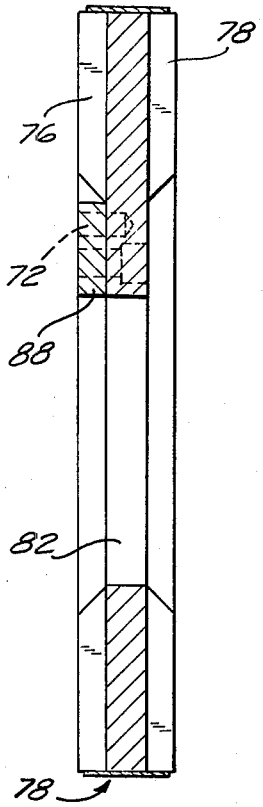
FIG. 3 is an axial sectional view as seen in the direction of arrows from the line III—III of FIG. 2.

As shown in FIGS. 2 and 3, the kidney-shaped openings 82 of the disc 28 can form part of a single opening having a diameter which is approximately half the diameter of the disc 28. The openings 82 are partially separated from each other by radially inwardly extending portions 84 one of which has the blind bore 72 and each of which has one or more untapped bores 86 for the respective screws 66. The portion 84 which is formed with the bore 72 may be thicker (as considered in the axial direction of the disc 28) than the other portions 84, for example, by welding to one side of the disc a small plate-like extension 88. The height of each rib 76 or 78 may be approximately ¾ inch, and the thickness or axial length of the disc 28 may be slightly in excess of one inch.

Figure 4:
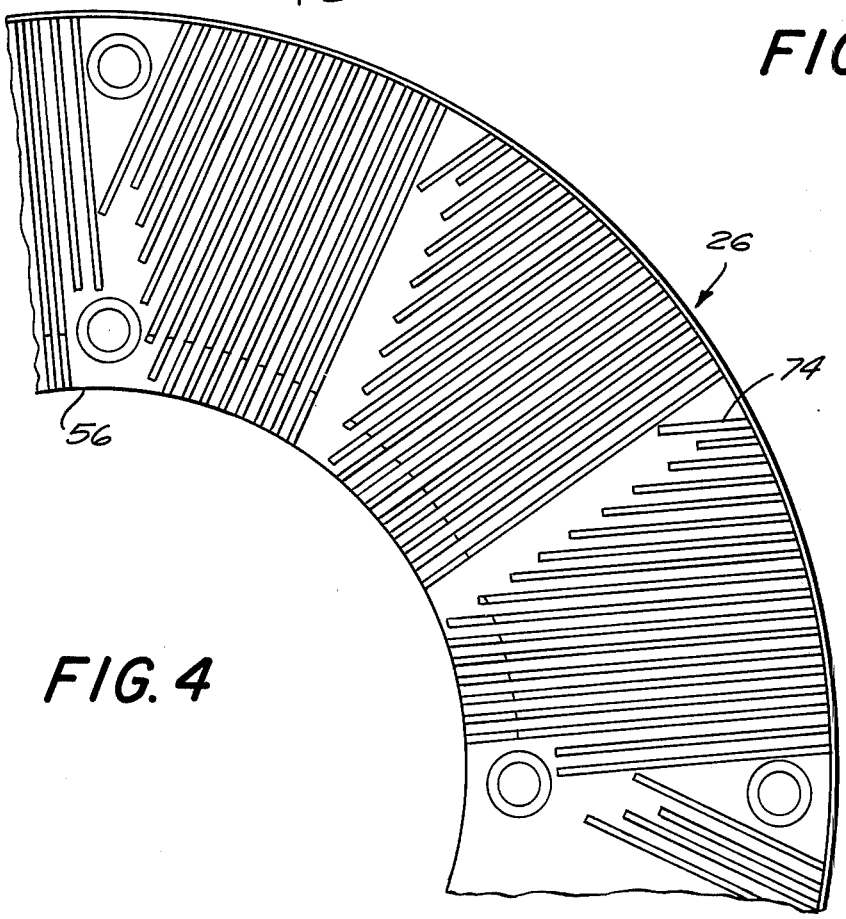
FIG. 4 is a fragmentary elevational view of the first refining member in the refiner of FIG. 1.

FIG. 4 shows a portion of the disc 26 which may be identical with the disc 30. The diameter of the opening 56 in the disc 26 is one-half the outer diameter of this disc. The height of the ribs 74 may be ¾ inch and the thickness of the disc 26 may be 3/5 inch, i.e., less than the height of a rib 74. The effective area of the opening 56 is that area of this opening which surrounds the corresponding portion of the shaft 50. The combined effective area of the openings 82 in the disc 28 is smaller than the effective area of the opening 56 because the disc 28 receives the hub 58 and also because this disc is formed with the portions 84. However, the combined effective area of the openings 82 is large enough to insure that the quantity of pulp which flows from the openings 82 into the path $P_2$ is identical or practically identical with the quantity of pulp flowing from the opening 56 into the path $P_1$. This insures that the wear upon the projections 74, 76, 78 and 80 is at least substantially uniform and prevents whirling which is a cause of uneven distribution of stock. When the wear upon these projections is sufficiently pronouned, the attendant starts the motor 38 to move the disc 30 toward the disc 26 whereby the disc 28 moves axially toward the disc 26 and finds for itself a central position between the discs 26 and 30. It is clear that, instead of mounting the disc 28 for axial movement on the hub 58 of the shaft 50, the hub 58 can move axially with the disc 28 (relative to the shaft 50), or the shaft 50 can move axially with the hub 58 and the disc 28.

FIG. 5 shows the hub 58. This hub has a keyway 59 for the key 60 and three radially outwardly extending arms 61 which overlie and are secured to the portions 84 of the disc 28. One of the arms 61 has the bore 68 for a portion of the guide pin 70 and each arm has at least one tapped bore 63 for the stem of the respective screw 66.

The omission of the aforementioned carrier brings about substantial savings in material and initial cost. As a rule, the discs are made of stainless steel. In the prior art constructions, the carrier for rotary discs is also made of stainless steel and is secured to the rotary discs by as many as 60 bolts or screws.

FIG. 6 shows a portion of a second refiner wherein the three defining members are annuli. The outermost refining member 126 is stationary and is affixed to a section 112 of the housing, the innermost refining member 130 is also stationary and is affixed to a shaft 114 or another section of the housing, and the median refining member 128 is rotatable by a motor M through the medium of a shaft 150. The paths for the flow of stock between the members 126, 128 130 are respectively shown at $P_1$ and $P_2$. In this refiner, one can compensate for wear upon the projections 174, 176, 178, 180 by expanding the rotary member 128 radially inwardly and outwardly, for example, by assembling this member of an outer ring of relatively movable arcuate portions and an inner ring or relatively movable arcuate portions (not specifically shown in the drawing).

FIG. 7 shows a portion of a modified refiner wherein the stationary refining members 226, 230 are hollow cones which are mirror symmetrical with respect to each other and the rotary refining member 228 is a twin cone disposed between the cones 226, 230. The shaft for the member 228 is shown at 250; the member 228 is movable (within limits) axially of the shaft 250; and the member 230 is adjustable axially of the shaft 250 in directions indicated by a double-headed arrow 231 (for example, by an adjusting mechanism similar to that described in connection with FIG. 1). The comminuting projections (not specifically shown) are provided on the conical internal surfaces of the members 226, 230 and on both conical external surfaces of the rotary member 228. The manner in which each half of the centrally located member 228 cooperates with the respective stationary member 226 or 230 is similar to that shown in FIG. 19 of the aforementioned patent to Pilao. The housing for the structure of FIG. 7 may have two inlets which respectively admit stock into the paths $P_1$ and $P_2$.

Without further analysis, the foregoing will so fully reveal the gist of the present invention that others can, by applying current knowledge, readily adapt it for various applications without omitting features which fairly constitute essential characteristics of the generic and specific aspects of my contribution to the art and, therefore, such adaptations should and are intended to be comprehended within the meaning and range of equivalence of the claims.

What is claimed as new and desired to be protected by Letters Patent is set forth in the appended claims:

1. A refiner for pulp or like materials, comprising a housing having a chamber, a material-admitting inlet and an outlet; spaced apart first and second refining discs mounted in said chamber; a rotary third refining disc disposed in said chamber between said first and second discs and defining therewith first and second paths for the movement of material from said inlet to said outlet, said discs being coaxial with each other and each being a one-piece disc, said first and second discs respectively having first and second comminuting projections adjacent to said first and second path and said third disc having third and fourth comminuting projections adjacent to said first and second path and respectively cooperating with said first and second projections to refine the material flowing along said first and second paths, means for rotating said third refining disc and comprising a shaft extending through a central opening provided in said first disc, a hub rigid with said shaft, and means for transmitting torque from said hub to said third disc, said third disc being movable axially of said hub and said hub comprising guide means for confining said third disc to axial movement relative to said hub, said second disc being movable axially toward and away from said third disc; and adjusting means for moving said second disc axially, said adjusting means comprising a support rigid with said second disc and movable in said housing axially of said discs and motor means for moving said support relative to said housing.

2. A refiner as defined in claim 1, wherein said comminuting projection on all refining discs are blades integral with the respective disc.

* * * * *